US005967131A

United States Patent [19]

Hervig

[11] Patent Number: 5,967,131

[45] Date of Patent: Oct. 19, 1999

[54] BOW WITH BRAKE ASSISTANCE

[76] Inventor: Dana P. Hervig, 1450 102nd St. E., Inver Grove Heights, Minn. 55077

[21] Appl. No.: 08/933,221

[22] Filed: Sep. 18, 1997

[51] Int. Cl.[6] ..... F41B 5/10

[52] U.S. Cl. ..... 124/25.6

[58] Field of Search ..... 124/23.1, 25.6, 124/86, 900; 188/24.21

[56] References Cited

U.S. PATENT DOCUMENTS

| | | | |
|---|---|---|---|
| 3,878,920 | 4/1975 | Fugii | 188/24.21 |
| 4,246,883 | 1/1981 | Ash | 124/25.6 |
| 4,294,221 | 10/1981 | Bryant | 124/25.6 |
| 4,471,747 | 9/1984 | Nishioka | 124/23.1 |
| 4,757,799 | 7/1988 | Bozek | 124/25.6 |
| 4,886,039 | 12/1989 | Wagner | 124/25.6 |
| 5,000,154 | 3/1991 | Slayton | 124/23.1 |
| 5,002,035 | 3/1991 | Brooks | 124/23.1 |
| 5,092,309 | 3/1992 | Beaton | 124/25.6 X |
| 5,146,908 | 9/1992 | Larson | 124/25.6 X |
| 5,465,705 | 11/1995 | Baeseman | 124/88 |

*Primary Examiner*—John A. Ricci
*Attorney, Agent, or Firm*—Merchant & Gould P.C.

[57] ABSTRACT

A bow with brake assistance includes a pair of bow limbs utilizing pulleys that aid in holding the bow in a compressed position when the bow's string is drawn. A disk surface moves concurrently with a wheel from one of the bow's pulleys. A brake caliper contains brake pads that squeeze and restrict the turning motion of the disc surface and thus hold the bow's limbs in a compressed position. The brake caliper can squeeze the brake pads together via a brake cable when a brake trigger is squeezed by an archer's finger. The brake trigger is positioned near the bow's handle so that it can be conveniently activated by the archer's finger.

8 Claims, 3 Drawing Sheets

BOW WITH BRAKE ASSISTANCE

TECHNICAL FIELD

This invention relates to brake assistance modification for a conventional compound bow. A conventional compound bow uses wheels and cables to form pulleys that assist in keeping the limbs of a bow compressed to make holding back a drawn bow string easier. The brake assistance modification presented by the present invention further reduces the effort required to hold a drawn bow string by restricting the motion of bow cables and wheels via applying friction to one of the bow wheels.

BACKGROUND OF THE INVENTION

When hunting with a bow, it is desirable to pull the bow's string back before a hunted animal comes close enough to detect the hunters action. Holding a drawn bowstring is a challenge for many hunters as it requires considerable strength and endurance. Compound bows currently on the market can reduce the effort required to hold back a drawn bowstring by approximately 65% of the effort required to attain the drawn position.

When the string of a compound bow is drawn back the limbs of the bow move from a relaxed position to a flexed or compressed position. As this is occuring, the wheels and cables of the bow are moving and gaining a mechanical advantage over the limbs of the bow.

The present invention applies friction to the cable wheels of the bow and makes holding a drawn bow string considerably easier. The embodiment shown presently adapts a disk surface, much like the surface of a automobile disk brake, to move concurrently or as a part of a wheel of the bow.

Pressure is applied to the disk using a lever, cable, and caliper brake system like the brake system used to squeeze the rim of a bicycle wheel. The brake lever or trigger is positioned near the bows handle so that it can be conveniently activated by the hunters finger once the bow string is drawn. Releasing the lever allows tension from holding a conventional compound bow to return to the arms of the archer. By applying stopping power to the bows cables or wheels (pulley system), the bow can be held back with minimal fatigue and allow archers whose strength isn't fully developed or adequate a better chance in hunting larger game.

The procedure to fire the present invention is:

1) Pull back or draw the bow string and arrow.
2) Press the brake activation lever on the bow handle to reduce required effort to hold the string back.
3) Release the activation lever to allow the bow wheels to turn and to receive an increase in tension on the bow string just before firing.
4) Fire the arrow by releasing the bow string from the fingers or from a mechanical release.

The present invention requires the shooting technique used to fire a conventional compound bow with the same initial force to draw the bow string. Pressure must be maintained on the brake lever to keep the brake activated and to keep pressure reduced on the archer's arms. The art of hunting is maintained with the present invention since it will not cock like a crossbow or other modified bow which can maintain a drawn bow string without attention from the archer.

SUMMARY OF THE INVENTION

In addition to the reduction in effort required to hold back a bow string provided by the pullies of a conventional compound bow, this invention allows a further reduction in muscular effort to hold back a drawn bow string. The invention is based on the principle that; applying friction to a compound bow's cable or wheel when the bow string is drawn will cause the bow's limbs to remain in a flexed position.

The bow with brake assistance that forms the basis of the present invention comprises in general, a conventional compound bow having a finger controlled or foot operated brake activation lever that can operate a caliper brake via a brake cable. The caliper brake uses brake pads that squeeze together and apply pressure to a brake disk surface on one of the bow's wheels. By stopping the bow wheels from turning when the bow string is drawn back, the muscular effort required of the hunter's arms and abdomen is reduced.

BRIEF DESCRIPTION OF THE DRAWINGS

The invention will be better understood, and objects other than those set forth above will become apparent when consideration is given to the following detailed description thereof Such description makes reference to the drawings wherein.

REFERENCE NUMERALS IN DRAWINGS

Figure 1:
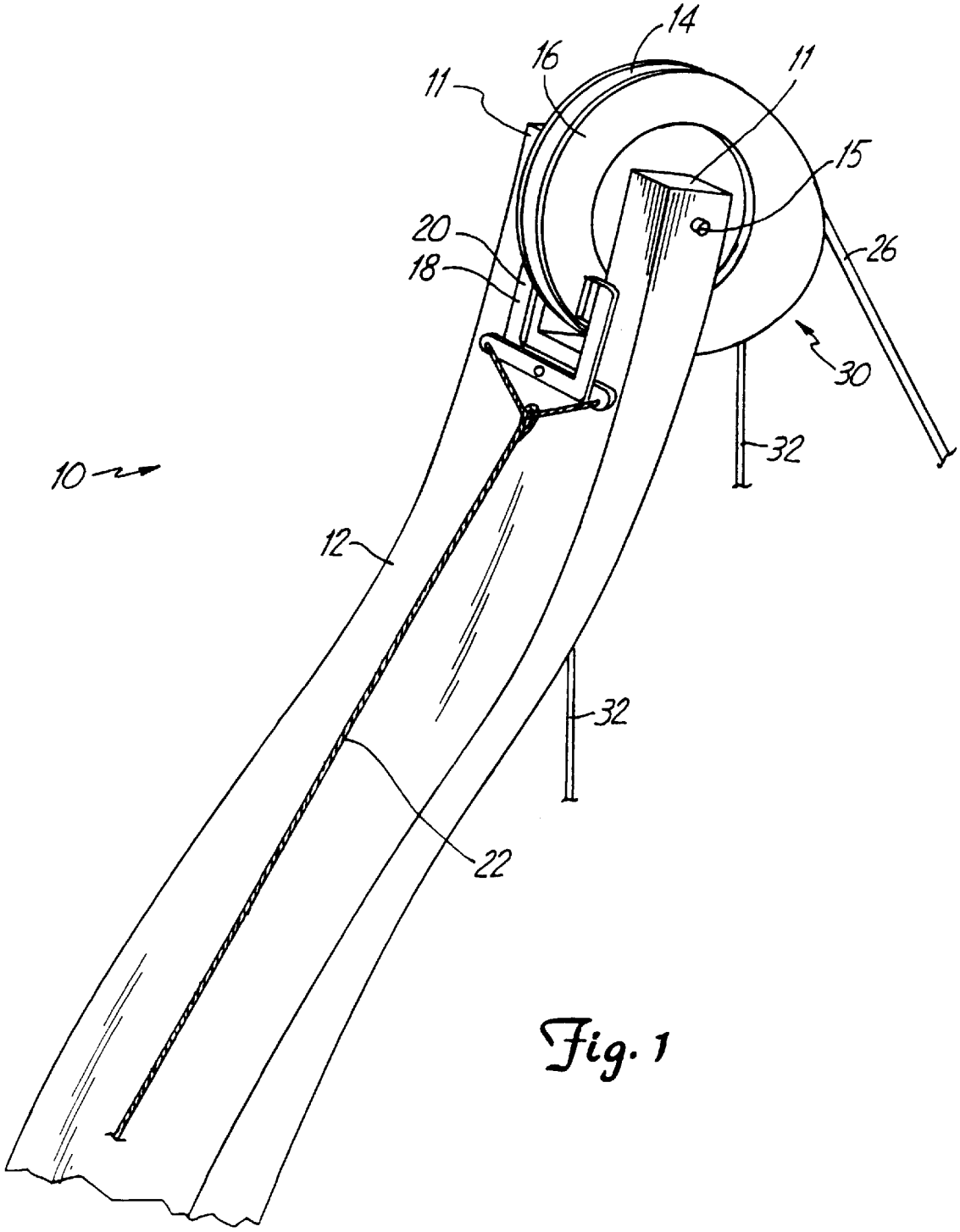
FIG. 1 is a perspective view of a bow with brake assistance.

10 Bow
11 Split tips
12 Limb
14 Wheel
15 Wheel axis
16 Disc surface
18 Caliper
20 Brake pad
22 Brake cable
24 Brake trigger
26 Bow string
28 Bow handle
30 Pulley
32 Bow cable
34 Arrow

DETAILED DESCRIPTION OF THE INVENTION

The preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

Figure 2:
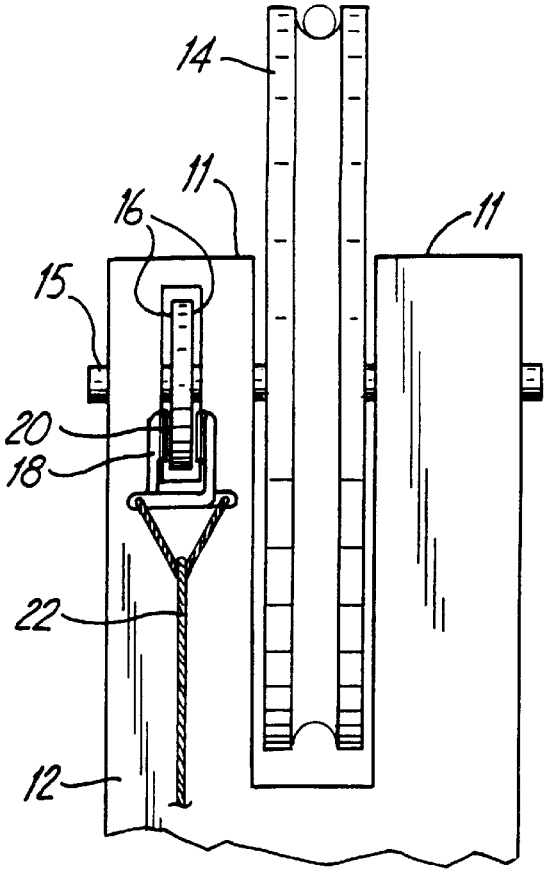
FIG. 2 is a perspective view of the present invention.
Figure 4:
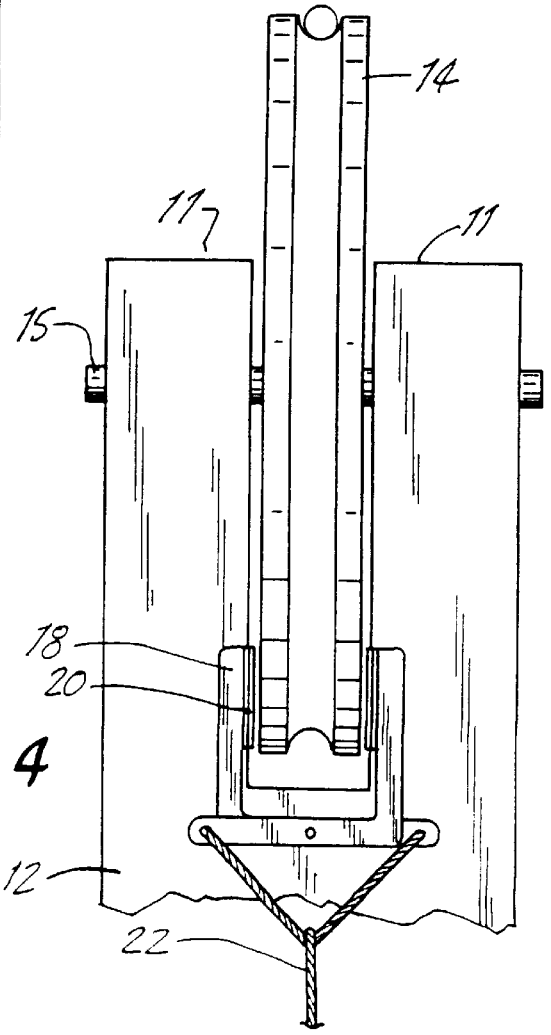
Figure 3:
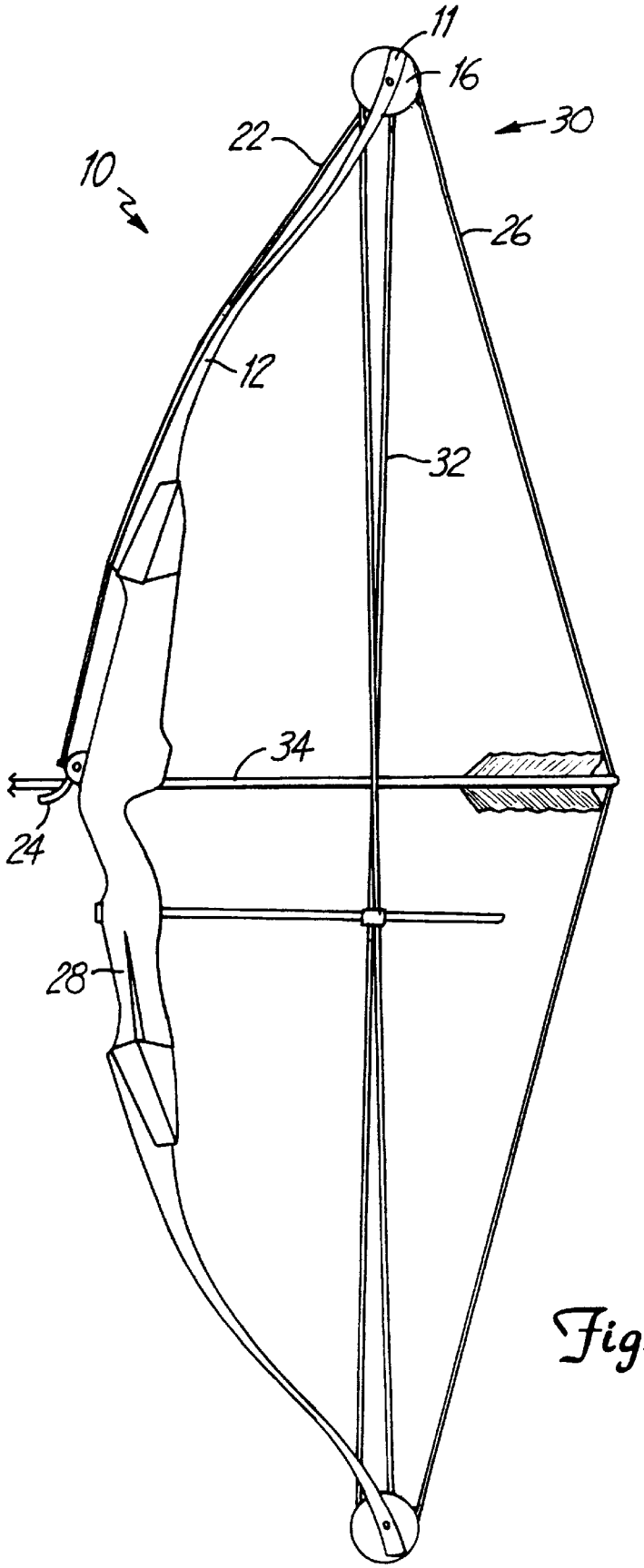
FIG. 3 is a side plan view of a bow according to principles of the present invention.

Referring now to FIGS. 1–3, the reference numeral 10, generally designates an embodiment of the bow with brake assistance according to the present invention. The bow 10 includes pair of flexible bow limbs 12 attached above and below a bow handle 28. Bow limbs 12 have split tips 11 that form a V-shape to allow a grooved bow wheel 14 to rotate about a wheel axis 15. The bow wheel 14 guides bow cable 32 and forms a pulley 30. Pulley 30 compresses bow limb 12 when bow string 26, which is connected to bow cable 32, is drawn back. A disk surface 16 moves concurrently with bow wheel 14. A brake caliper 18 mounted to bow limb 12 contains brake pads 20 that can squeeze and restrict the turning motion of disc surface 16 and hold the limbs 12 of bow 10 in a compressed position by stopping the motion of pulley 30. Brake caliper 18 will squeeze brake pads 20 together via a brake cable 22 when a brake trigger lever 24 is squeezed by an archer's finger (not shown). Brake trigger 24 is positioned near bow handle 28 so that it can be conveniently activated by the archers finger to relieve pressure on the archers arms, shoulders, back, and chest once the bow string and arrow 34 is drawn. While the invention has been described in conjunction with a specific embodiment thereof, it is evident that different alternatives, modifications, variations, and uses will be apparent to those skilled in the art, in view of the foregoing description. Accordingly, the invention is not limited to these embodiments or the use of elements having specific configurations and shapes as presented herein.

What is claimed is:

1. A bow comprising:

(a) two bow limbs attached above and below a bow handle;

(b) two grooved bow wheels each rotatably mounted about a wheel axis, wherein one of the bow wheels provides a braking surface to receive the application and release of friction;

(c) said bow limbs having tips that provide attachment of said bow wheels;

(d) first and second bow cables guided by the bow wheels to form pulleys for compression of the bow limbs;

(e) said first and second cables connected to opposite ends of a bow string supported by and extending between opposite ends of the bow limbs;

(f) a remotely controlled brake engageable with the braking surface whereby an archer may selectively engage or disengage the brake with the braking surface.

2. A bow according to claim 1, wherein said brake comprises a brake caliper having brake pads mounted to said bow limb.

3. bow according to claim 2, wherein said brake further comprises a brake trigger lever connected to a brake cable for engaging and disengaging the brake caliper and brake pads with the braking surface of the bow wheel.

4. A bow according to claim 3, wherein said brake trigger is provided on the bow handle.

5. A bow comprising:

(a) two bow limbs attached above and below a bow handle;

(b) two grooved bow wheels, each bow wheel rotatably mounted about a wheel axis, wherein one of the bow wheels provides a braking surface;

(c) said bow wheels being attached to said bow for guidance of a bow string;

(d) said bow string which, when drawn, causes compression of the bow limbs by application of tension across said bow wheels; and (e) a remotely controlled brake engageable with the braking surface whereby an archer may selectively engage or disengage the brake with the braking surface.

6. A bow comprising:

(a) two bow limbs attached above and below a bow handle;

(b) two grooved bow wheels, each bow wheel rotatably mounted about a wheel axis;

(c) said bow wheels being attached to said bow for guidance of a bow string;

(d) a braking surface upon which contact thereof causes one of the bow wheels to limit rotating about said wheel axis;

(e) said bow string which, when drawn, causes compression of the bow limbs by application of tension across said bow wheels; and (f) a remotely controlled brake engageable with the braking surface whereby an archer may selectively engage or disengage the brake with the braking surface.

7. A bow according to claim 5, wherein the braking surface is provided on the one of the bow wheels.

8. A bow according to claim 6, wherein the braking surface is provided on a disk rotatably connected to the one of the bow wheels.

* * * * *